US005211049A

United States Patent [19]

Lucas

[11] Patent Number: 5,211,049

[45] Date of Patent: May 18, 1993

[54] JOINING-CRIMPING DEVICE FOR ASSEMBLY OF TYPE F CONNECTORS TO COAX CABLE

[76] Inventor: David J. Lucas, 12044 Moran, Hamtramck, Mich. 48212

[21] Appl. No.: 888,514

[22] Filed: May 26, 1992

[51] Int. Cl.[5] ..... H01R 43/042

[52] U.S. Cl. ..... 72/410; 29/751; 29/263; 29/268; 81/421

[58] Field of Search ..... 72/410, 409, 404, 317; 29/751, 753, 758, 263, 268; 81/421, 422, 424

[56] References Cited

U.S. PATENT DOCUMENTS

| | | | |
|---|---|---|---|
| 1,571,267 | 2/1926 | Hartsock | 72/317 |
| 2,933,000 | 4/1960 | Wood | 72/410 |
| 3,484,921 | 12/1969 | Ziegler | 29/751 |
| 3,651,557 | 3/1972 | Bagley | 29/263 |
| 3,713,322 | 1/1973 | Fischer | 72/410 |
| 3,800,584 | 4/1974 | Edwards | 29/751 |
| 4,649,634 | 3/1987 | Mykkanen | 29/751 |

FOREIGN PATENT DOCUMENTS

| | | | |
|---|---|---|---|
| 16041 | of 1898 | United Kingdom | 72/317 |

*Primary Examiner*—Daniel C. Crane

[57] ABSTRACT

A hand held plier type tool for connecting type F connectors to coax cable includes tool-jaws with stations for crimping F connector ferrules as well as a station for gripping the end of the cable. A loosely assembled F connector and cable assembly is held in position by the cable gripping station where a clamp screw mechanism is employed to force the F connector's barb under the jacket of the coax cable. One embodiment of the tool includes too-jaws and clamp mechanism that are separate and replaceable to a set of plural handles.

6 Claims, 4 Drawing Sheets

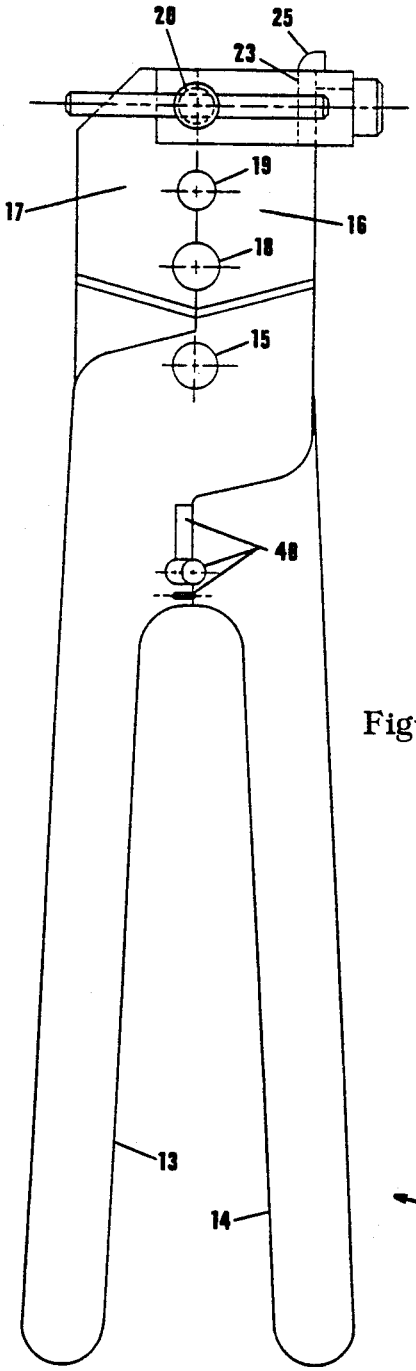
Figure 1
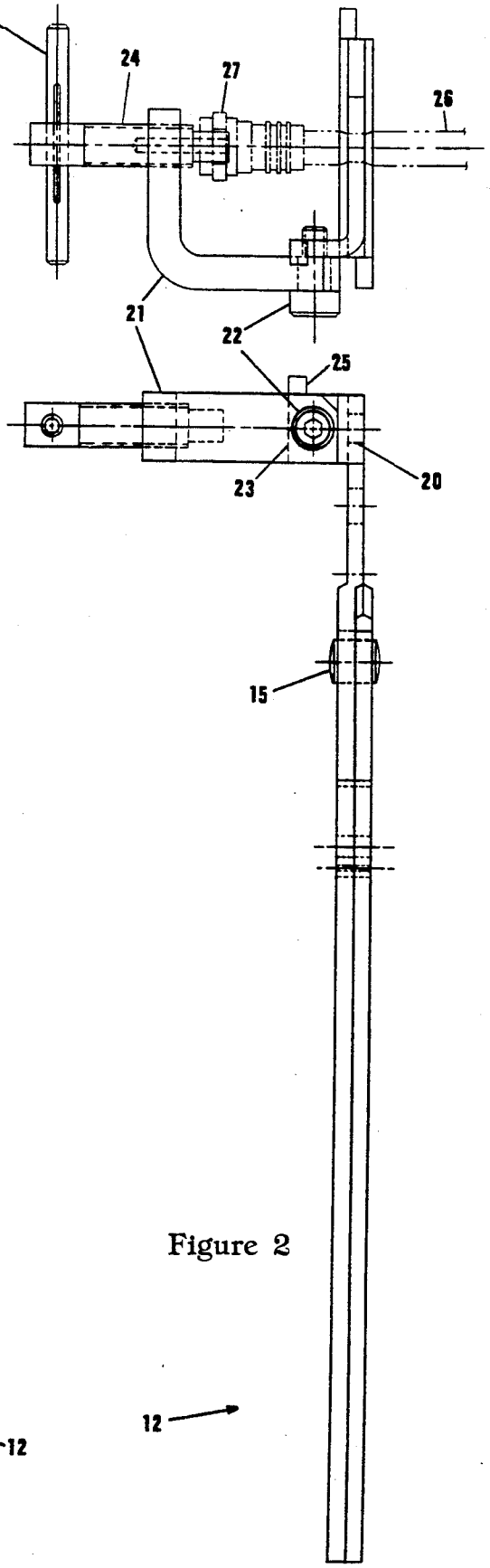
Figure 3
Figure 2

Figure 9
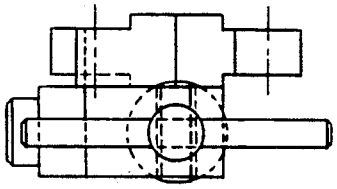
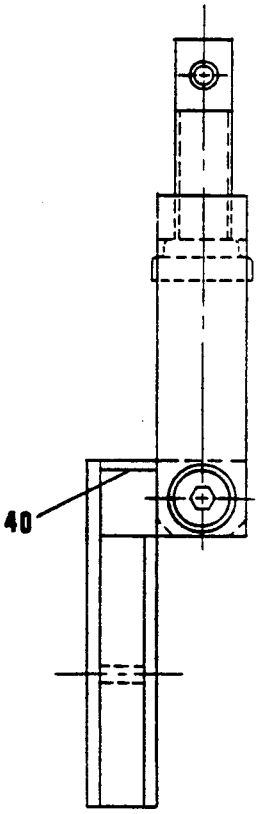
Figure 8
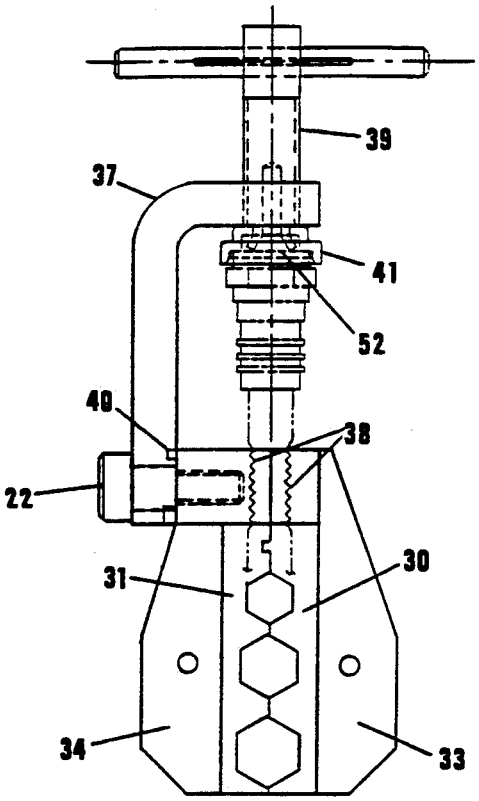
Figure 7

JOINING-CRIMPING DEVICE FOR ASSEMBLY OF TYPE F CONNECTORS TO COAX CABLE

TECHNICAL FIELD

The present invention broadly relates to hand held tools especially of the plier type and deals more particularly with a Joining and Crimping device that assists a user in the assembly of type F connectors to coax cable.

BACKGROUND ART

Various plier type crimping devices have been devised for crimping Type F connectors to coax cable. As used herein, the term-"F connector" is used to describe Type "F" connector plugs as recognized by the National Electric Code and used as an industry standard coax cable terminator for connecting coax cable to various video and electronics equipment such as VCR's and TV's as well as signal distribution devices such as splitters, transformers, switches and amplifiers.

There are three steps (assembly operations) involved in the assembly of F connectors to coax cable: 1) preparing the end of the cable for assembly, 2) fitting the connector onto the prepared end of the cable, and 3) crimping the F connector permanently to the cable.

F connector crimping devices in the past have been specifically designed to crush the tubular portion of an F connector (hereinafter referred to as the "ferrule") over the outer jacket of the subject cable thus providing a permanently crimped interference fit assembly. Depending on the manufacturer of the F connector, the ferrule may be incorporated as the body of the connector or as a separate tubular ring, although providing the same purpose and required method of crimp.

These crimping devices generally involve hand held plier type tools that include specifically designed tool-jaws that close around the ferrule to form the ferrule properly around the coax cable. The tool-jaws may have round or hexagon crimping stations of different sizes to accept the ferrules of different size F connectors for various coax cable. Furthermore, the tool-jaws may be incorporated into the plier type tool as separate replaceable dies or can be manufactured as part of the plier body. Furthermore, these plier type crimping devices may be designed to pivot the tool-jaws about a single pin or can include multiple pivoting pins to provide a compounding action to increase the tool-jaw's closure force by moment action. Some crimping tools may also include coax cable outer jacket and inner shield and core stripping stations to prepare the end of the cable before assembly to the F connector.

Although the F connector crimp tools stated above are designed to effectively provide a means for the Ferrule crimping operation (step No. 3) and can include a means for assisting a user in the preparation operation (step No. 1) of the end of the cable for termination, these devices are deficient in assisting a user in the well known problems encountered in the initial assembly operation (step No. 2) of fitting the F connector onto the coax cable prior to crimping:

After the end of the coax cable is prepared for assembly to the F connector by removing a portion of outer jacket and inner shield and core, the F connector's barb must then be forcefully inserted under the coax cable's outer jacket by hand, a strenuous task, before the F connector can be crimped to the cable. This method of assembly is extremely difficult in most cases because the force required is substantial, and causes the cable to slip between the fingers.

Technicians in the growing communications industry who are required to perform several assembly operations per day routinely develop painful blisters on their fingers from both the gripping of the cable and also the gripping of the F connector. Gloves have been an impractical remedy to the solution because of the fine detail in the art of the three assembly operations as well as other considerations involved in a technicians duties. Furthermore, gloves do not reduce the amount of force required for the initial assembly operation, thereby still allowing the cable to slip between the fingers. Thus, even with gloves, assembly operation No. 2 remains a strenuous task.

Screw-on type F connectors that do not require the crimping of a ferrule have been developed in an attempt to eliminate the crimping operation and provide an alternate method of assembly. However, these screw-on type of F connectors are undesirable because they also require substantial gripping force resulting in blisters. In many cases they are impossible to assemble due to the variance in the outside diameters of the different types of coax cable. As a result, they have limited use.

INDUSTRIAL APPLICABILITY

It is therefore a primary objective of the present invention to overcome the deficiencies inherent in the assembly of crimp type F connectors as stated above.

Further important object of the present invention is to provide a hand held plier type tool that will assist a user to insert an F connector barb under the outer jacket of coax cable prior to crimping.

Another object of the invention is to provide a tool as stated above that will grip and hold the end of a coax cable while the joining operation of inserting an F connector's barb under the outer jacket of a coax cable is being completed.

A further object of the invention is to provide a tool that will grip the end of a coax cable as stated above that includes a clamp mechanism to push an F connector over the end of a coax cable in a manor which forces the F connector's barb under the outer jacket of said coax cable.

Another object of the present invention is to incorporate an F connector crimping station into the invention as stated above to provide a combination Joining-Crimping device for assembly of F type connectors to coax cable.

In accordance with the present invention, a hand held plier type tool that will assist a user to insert an F connector's barb under the outer jacket of coax cable includes a means of gripping and holding the end of a coax cable while a clamp mechanism is employed to force the F connector's barb under the coax cable's outer jacket. A crimping station is also included to provide a means for the crimping operation for permanently securing the F connector to coax cable.

BRIEF DESCRIPTION OF THE DRAWINGS

In the drawings, which form an integral part of the specification and are to be read in conjunction therewith, and in which like reference numerals are employed to designate substantially identical components in the various views:

FIG. 1 is a top view of an F connector joining and crimping device which forms the preferred embodiment of the present invention with its clamp assembly in ready for use position.

FIG. 2 is a side view of the joining and crimping device shown in FIG. 1.

FIG. 3 is a front view of the joining and crimping device of FIG. 2 and also showing an F connector and coax cable in preliminary assembled position.

FIG. 7 is a plan view of tool-jaws and clamp assembly including F connector and coax cable which show another form of the present invention as being separate and replaceable to plural handles shown in FIGS. 8 and 11.

FIG. 8 is a side view of tool-jaws and clamp assembly of FIG. 7.

FIG. 9 is a front view of tool-jaws and clamp assembly of FIG. 7.

BEST MODE FOR CARRYING OUT THE INVENTION

Figure 5:
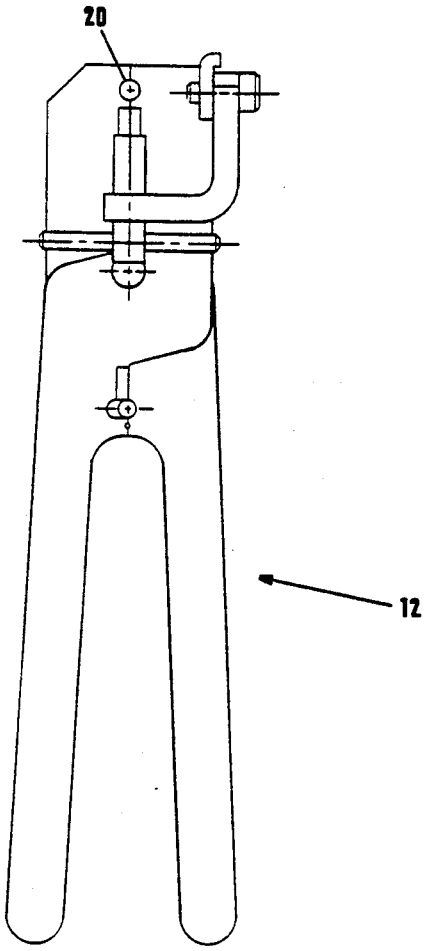
FIG. 5 is a top plan view of the joining and crimping devise of FIG. 1 shown with its clamp assembly in stored position.

Referring first to FIGS. 1-2, the present invention generally involves a joining and crimping tool of the hand held plier type for assembly of F connectors to coax cable. The joining and crimping tool 12 includes two handles 13 and 14 that are connected together by and pivot about pin 15. Tool-jaws 16 and 17 are integrated as part of handles 13 and 14 and pivot about pin 15 opposite handles 13 and 14.

Formed into tool-jaws 16 and 17 are F connector ferrule crimping stations 18 and 19 as well as coax cable gripping station 20. A clamp bracket 21 is fastened to tool-jaw 16 by a screw 22 passing through clamp bracket 21 and threading into bracket tab 23. Bracket tab 23 is formed as an integral part of tool-jaw-16.

Clamp bracket 21 is substantially 'L' shaped and extends over cable gripping station 20 when clamp bracket 21 is pivotally held in position over cable gripping station 20 by resting against stop tab 25. Stop tab 25 is formed as an integral part of bracket tab 23. Clamp screw 24 is threaded through the end of clamp bracket 21 in a manor that positions clamp screw 24 perpendicular to handles 13 and 14 and in axially centered relationship to and over cable gripping station 20.

Figure 4:
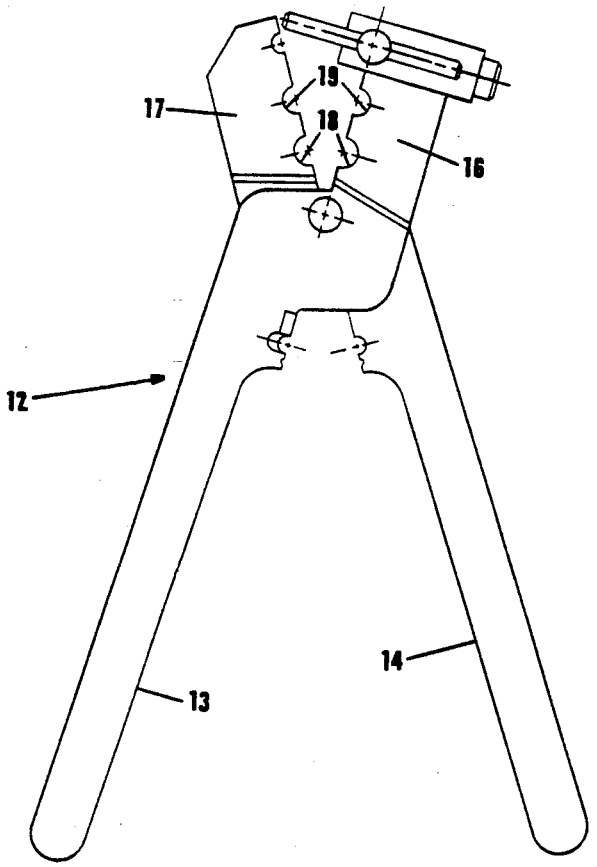
FIG. 4 is a top plan view of the joining and crimping device of FIG. 1 shown in its open position.
Figure 6:
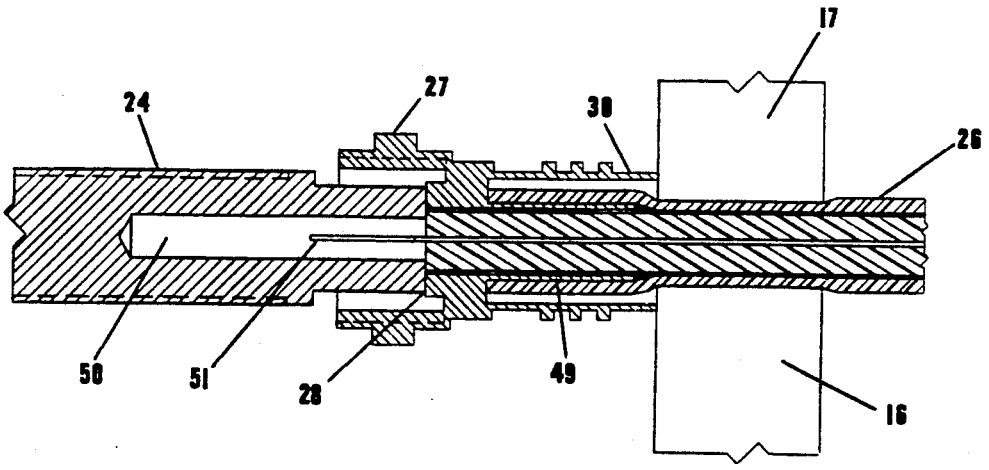
FIG. 6 is a cross section of a properly fitted F connector and coax cable assembly showing clamp screw and tool-jaw interface.

Attention is now directed to FIGS. 3-6 which depict the joining crimping tool 12 in its various stages of use. The end of a coax cable 26 can be prepared by shearing said cable's outer jacket and inner shield and core by closure of handles 13 and 14 after said cable is placed within cable stripping stations 48.

An F connector 27 is placed over the prepared end of coax cable 26 forming a loosely fitted connector-cable assembly. After clamp bracket 21 has been pivoted in place over cable gripping station 20, the open end of F connector 27 of said loosely fitted connector-cable assembly is placed over the end of clamp screw 24 thus making contact at interface 28. Coax cable 26 rests within cable gripping station 20 of tool-jaw 16 and is held in place within cable gripping station 20 by closure of tool-jaw 17 to tool-jaw 16.

With said loosely fitted connector-cable assembly held in place, clamp screw 24 is turned by handle 29 forcing F connector 27 axially toward coax cable 26 forcing F connector barb 49 under outer jacket of coax cable 26 thus forming a properly fitted connector-cable assembly. Hole 50 is integrated into clamp screw 24 to allow clearance for center conductor 51 of coax cable 26.

Said properly fitted connector-cable assembly is released from plier type tool 12 by pivoting tool-jaws 16 and 17 to their open position where F connector crimping stations 18 and 19 are then closed over F connector ferrule 30 for crimping, thus forming a permanently fitted connector-cable assembly. Clamp bracket 21 is pivoted about screw 22 and positioned relatively parallel to and against handles 13 and 14 for storage.

Figure 11:
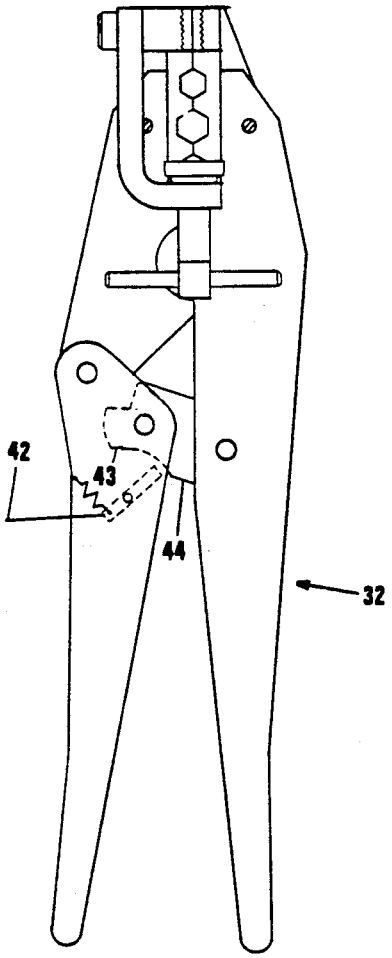
FIG. 11 is a plan view of the alternate invention shown in its stored position.
Figure 10:
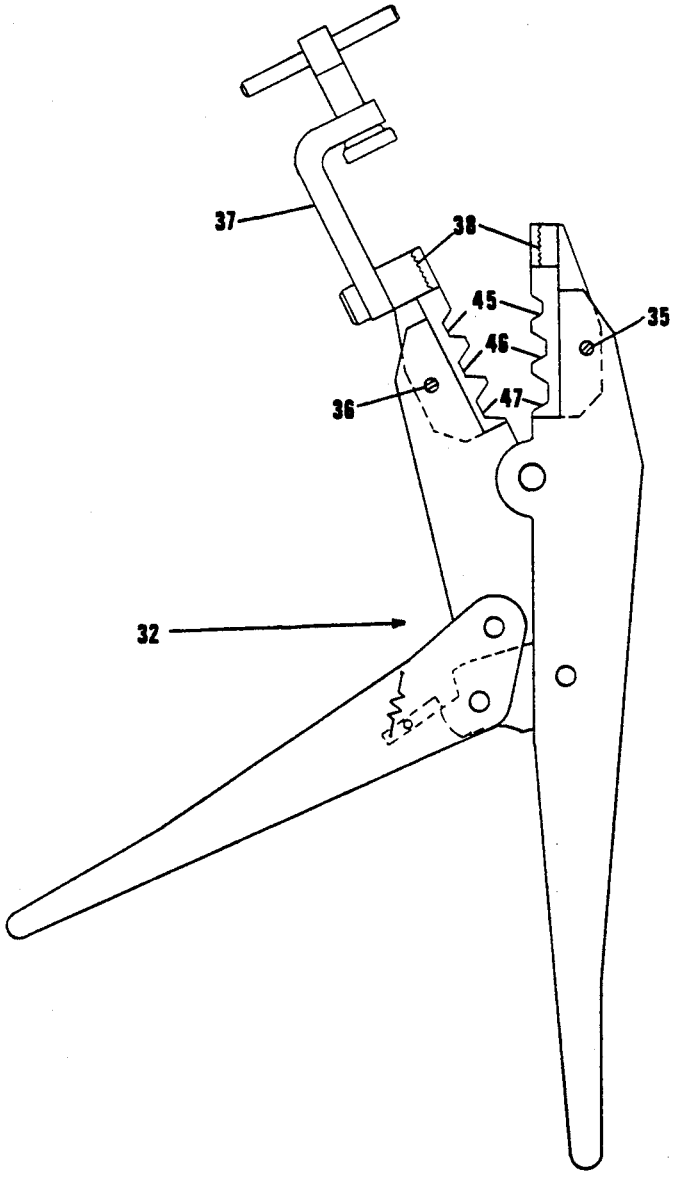
FIG. 10 is a plan view of the tool-jaws and clamp assembly of FIG. 7 shown installed within a set of plural handles forming the alternate form of the present invention in its open for use position.

Attention is now directed to FIGS. 7-11 which show another form of the present invention that depicts tool-jaws 30 and 31 as being separate and replaceable within a set of relatively movable plural handles 32. Tool-jaws 30 and 31 are mounted in channels within plural handles 32 by screws 35 and 36 to mating tool-jaw flanges 33 and 34 formed integrally to their respective tool-jaws 30 and 31.

Clamp bracket 37 positions clamp screw 39 parallel to plural handles 32 and centered in linear relationship to cable gripping station 38 when clamp bracket 37 is pivotally held in position over cable gripping station 38 by stop pad 40.

After clamp bracket 37 has been pivoted in place over cable gripping station 38, the open end of F connector 27 of said loosely fitted connector-cable assembly is placed within opening of clamp cap 41 thus making contact at interface 52. Coax cable 26 rests against cable gripping station 38 of tool-jaw 31 and is held in place within cable gripping station 38 by closure of tool-jaw 30 to tool-jaw 31 and is locked in position by engagement of latch 42 to notch 43 of bar 44 within plural handles 32.

With said loosely fitted connector-cable assembly held in place, clamp screw 39 is turned to force F connector barb 49 under outer jacket of coax cable 26 thus forming a properly fitted connector-cable assembly. By further compressing plural handles 32 beyond locked position, latch 42 is released allowing plural handles 32 to open thus releasing said properly fitted connector-cable assembly where crimp stations 45,46 or 47 are then placed over ferrule 30 for crimping. Clamp bracket 37 is pivoted about screw 22 and positioned parallel to plural handles for storage.

In view of the foregoing, it is apparent that the joining and crimping tools as described above not only provide for the reliable accomplishment of the objectives of the invention but do so in a particularly efficient and economical manor. It is recognized, of course, that those skilled in the art may make various modifications or additions to the preferred embodiment chosen to illustrate the invention without departing from the scope and spirit of the present contribution to the art. Accordingly, it is to be understood that the protection sought and to be afforded hereby should be deemed to extend to the subject matter claimed and all equivalents thereof fairly within the scope of the invention.

I claim:

1. A joining-crimping device for assembly of type F connectors to coax cable comprising:

tool-jaws positioned by relatively movable plural handles, said tool-jaws having a coax cable gripping station to grip and hold a coax cable, said tool-jaws include stations for crimping F connector ferrules to said coax cable;

a clamp bracket with means of attachment to said tool-jaws where an end of said clamp bracket extends generally over said cable gripping station;

a clamp screw threaded through said end of said clamp bracket where said clamp screw is parallel to said coax cable as said coax cable is being held by said cable gripping station by closure of said plural handles, an end of said clamp screw contacts an F connector that is loosely fitted over a prepared end of said coax cable that is held in said cable gripping station, said end of said clamp screw being hollow to allow clearance for a center conductor of said prepared end;

a handle with means of attachment to said end of said clamp screw opposite said F connector that turns by hand moving said clamp screw and said F connector longitudinally toward said coax cable forcing said F connector's barb under the outer jacket of said coax cable thus forming an F connector coax cable assembly.

2. The joining crimping device of claim 1 wherein a clamp cap with means of attachment to said end of said clamp screw is the contacting member to said F connector.

3. The joining crimping device of claim 2 wherein said clamp cap is stationary relative to said F connector while said clamp screw is turned.

4. The joining crimping device of claim 1 wherein said tool-jaws are separate replaceable tool-jaws with means of attachment to said plural handles.

5. The joining crimping device of claim 1 wherein said clamp bracket includes means of attachment where said clamp bracket pivots axially about said tool-jaws to allow said clamp bracket to be positioned parallel and in side by side relationship to said plural handles for storage.

6. The joining crimping devise of claim 5 wherein said tool-jaws include a means for holding said end of said clamp bracket in position over said cable gripping station prior to F connector placement within said joining crimping device.

* * * * *